US006579059B2

(12) United States Patent
Chen

(10) Patent No.: US 6,579,059 B2
(45) Date of Patent: Jun. 17, 2003

(54) COLLATOR FOR PRINTER

(75) Inventor: Philip L. Chen, Hsin-Chu Hsien, CA (US)

(73) Assignee: Avision Inc., Hsin-Chu (TW)

( * ) Notice: Subject to any disclaimer, the term of this patent is extended or adjusted under 35 U.S.C. 154(b) by 0 days.

(21) Appl. No.: 10/063,913

(22) Filed: May 23, 2002

(65) Prior Publication Data

US 2002/0159877 A1 Oct. 31, 2002

Related U.S. Application Data

(62) Division of application No. 09/078,739, filed on May 14, 1998, now Pat. No. 6,398,481.

(51) Int. Cl.[7] ..... B65H 33/08
(52) U.S. Cl. ..... 414/791.2; 271/207; 271/213
(58) Field of Search ..... 414/791.2; 271/207, 271/213

(56) References Cited

U.S. PATENT DOCUMENTS

| | | | | | |
|---|---|---|---|---|---|
| 3,058,361 | A | * | 10/1962 | Freeborn | 74/26 |
| 3,451,276 | A | * | 6/1969 | Wadlow et al. | 74/50 |
| 4,188,025 | A | * | 2/1980 | Gusfafson et al. | 271/314 |
| 4,208,122 | A | * | 6/1980 | Iwamoto et al. | 399/403 |
| 4,293,214 | A | * | 10/1981 | George et al. | 399/403 |
| 4,354,787 | A | * | 10/1982 | Gensike et al. | 414/791.2 |
| 4,382,592 | A | * | 5/1983 | Harding et al. | 270/58.01 |
| 4,664,507 | A | * | 5/1987 | Fukae et al. | 347/138 |
| 4,964,741 | A | * | 10/1990 | Gaerte | 384/475 |
| 5,173,785 | A | * | 12/1992 | Muramatsu | 358/400 |
| 5,203,550 | A | * | 4/1993 | Kawano et al. | 270/58.14 |
| 5,431,387 | A | * | 7/1995 | Loben et al. | 271/213 |

* cited by examiner

*Primary Examiner*—Patrick H. Mackey
(74) *Attorney, Agent, or Firm*—Winston Hsu

(57) ABSTRACT

A single tray is used to collate the printed papers from a printer. The tray is moved to different positions to receive the printed papers. Thus, the printed papers are collated into different stacks. The movement of the tray can be linear or curvilinear. The circular movement can collate the printed papers into more than two stacks.

2 Claims, 18 Drawing Sheets

COLLATOR FOR PRINTER

CROSS REFERENCE TO RELATED APPLICATIONS

This is a division of application Ser. No. 09/078,739 filed, May 14, 1998 is now U.S. Pat. No. 6,398,481.

BACKGROUND OF INVENTION

1. Field of the Invention

This invention relates to collators for printers.

2. Background of the Related Art

Among the peripheral equipment for a computer, a printer is an important one. For the output of the printer, collating is an important function. Conventional collators customarily use a multiple tray structure to sort the printed sheets. Such a design is very complicated and hence very costly.

A conventional multiple tray collator typically has the following operation. If a stack of document has, say, 5 pages, the pages are numbered as #1, #2, #3, #4 and #5. If three copies are to be outputted, the output can have at least the three following modes: (1) Select in the first tray three copies #1, #1, #1; in the second tray three copies #2, #2, #2, in the third tray three copies #3, #3, #3; in the fourth tray three copies #4, #4, #4; and in the fifth tray three copies #5, #5, #5. Then the copies in each tray are taken out and manually collate them in the order #1, #2, #3, #4, #5 into three stacks.

(2) Select in the first tray five pages #1, #2, #3, #4, #5; in the second tray five pages #1, #2, #3, #4, #5, in the third tray five pages #1, #2, #3, #4, #5.

(3) Select different numbers for different pages. For instance: the first tray has five pages, #1, #2, #3, #4, #5; the second tray has three pages #1, #2, #3; and the third tray has four pages #1, #3, #4, #5.

In all the foregoing output traditional methods, a multiple tray collating equipment is used. The structure is very complicated, costly, and unreliable.

SUMMARY OF INVENTION

An object of this invention is to use a single tray to collate papers for a printer. Another object of this invention is to provide a collator that simplifies the structure, reduces the cost, and is more reliable. Still another object of the invention is to miniaturize the collator to be lighter and thinner.

These objects are achieved by using a single tray and moving the tray in different positions to collate the printed papers into different stacks. The movement may be a linear one or a circular one. The printed papers can be collated into multiple numbers of stacks.

DETAILED DESCRIPTION

Figure 1A:
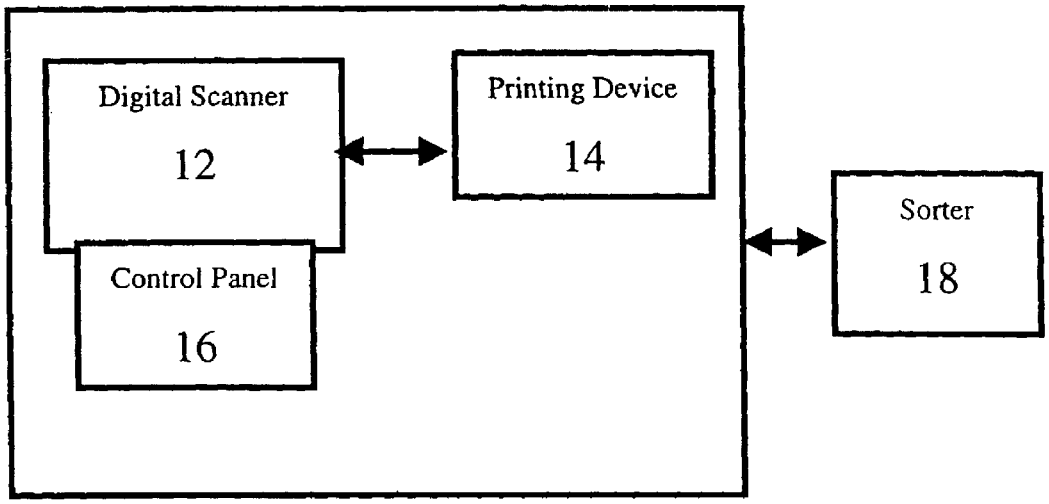
Fig. 1A Prior art
FIG. 1A shows the block diagram of a conventional collator.

FIG. 1A shows a block diagram of a printer system. A digital scanner 12 sends its data to a printing device 14 to provide a printed output. The printing device 14 has a central processing unit (not shown), which controls the operation of the collator or sorter 18. A control panel 16 allows a user to select the printer requirements.

Figure 1B:
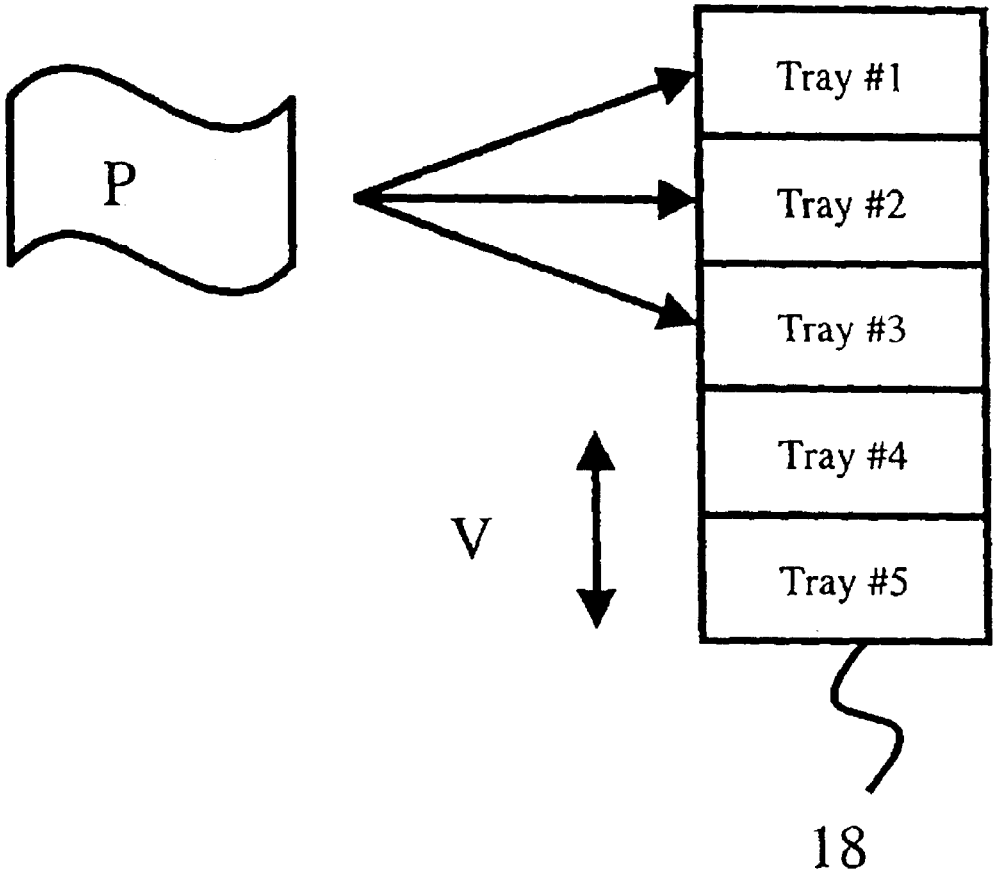
Fig. 1B. Prior art
FIG. 1B shows the page dispensing scheme of a conventional collator.

FIG. 1B shows the structure of a prior art collator of a printer. After finishing printing, the printed papers P are dispatched to the collator. For the purpose of explanation, the collator shown has five trays: Tray #1, Tray #2, Tray #3, Tray #4, and Tray #5. The collator 18 dispatches the printed papers to the different trays according to the instruction from the central processing unit (CPU, not shown), which controls the vertical motion of the collator 18 to collect the printed papers.

Figure 1C:
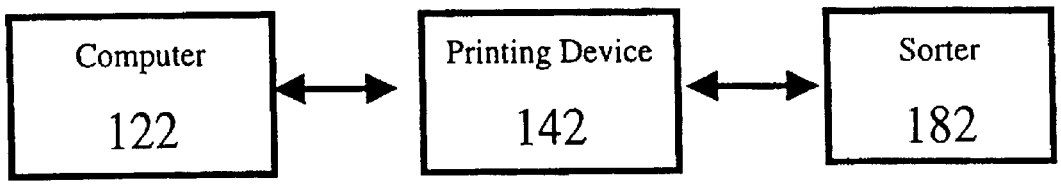
Fig. 1C. Prior art
FIG. 1C shows the interconnection among a computer, a printer and a sorter.

FIG. 1C shows the connection between the printing device 142 with the computer 122 and the connection between the printing device 142 with the collator 182.

Figure 2A:
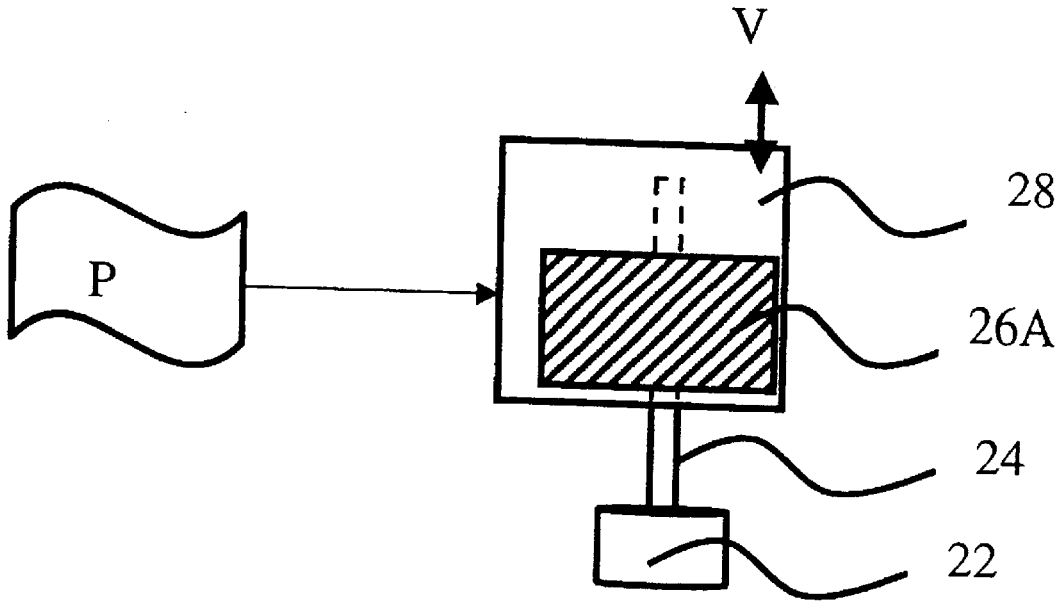
FIG. 2A shows the design of the collator based on the present invention.
Figure 2B:
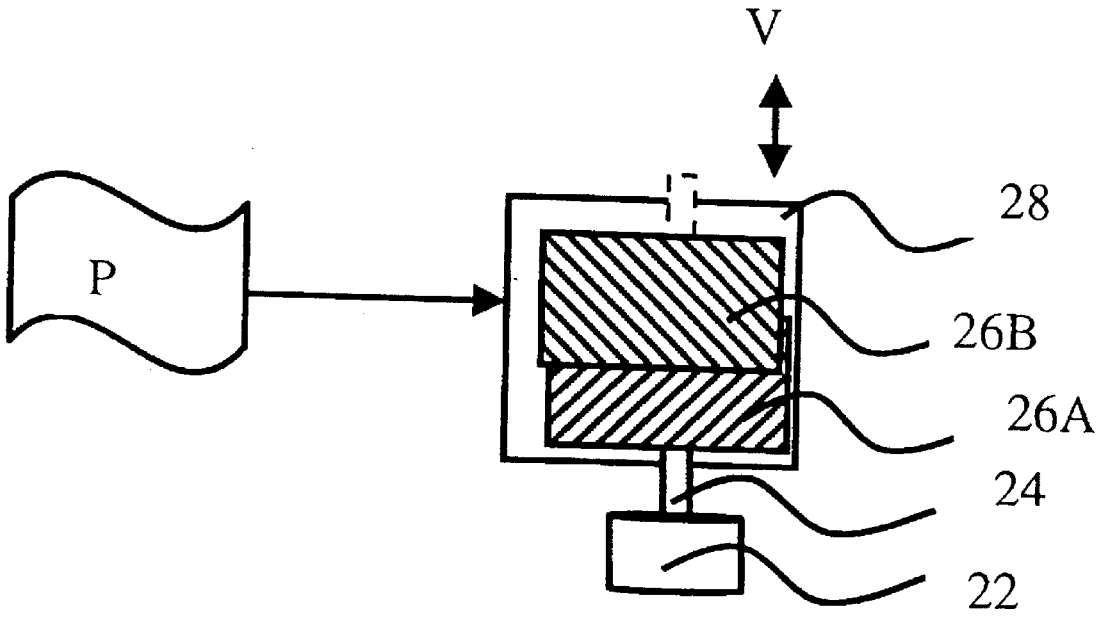
FIG. 2B shows the basic operation of the collator based on the present invention.
Figure 2C:
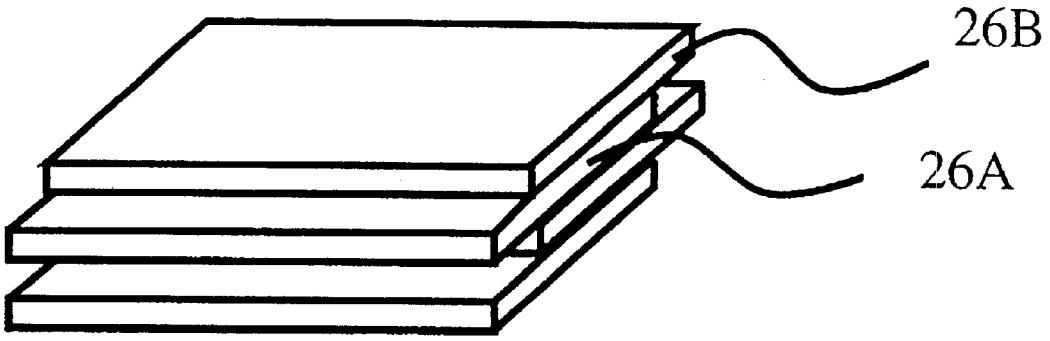
FIG. 2C shows the resulting stacking of the pages of the present invention.

FIG. 2A and FIG. 2B show the first embodiment of the present invention. There is only one tray 28, which is capable of moving back and forth in the V direction. A motor 22 pushes the push rod 24 according to instructions from the CPU and causes the tray 28 to move back and forth in the V direction. In FIG. 2A, the tray is in a first position and stacks the documents as a stack 26A. In FIG. 2B, the tray 28 is in a second position and stacks the second group of documents as a stack 26B. Stack 26A and stack 26B are staggered as shown in FIG. 2C, and are thus separated and collated.

Figure 3A:
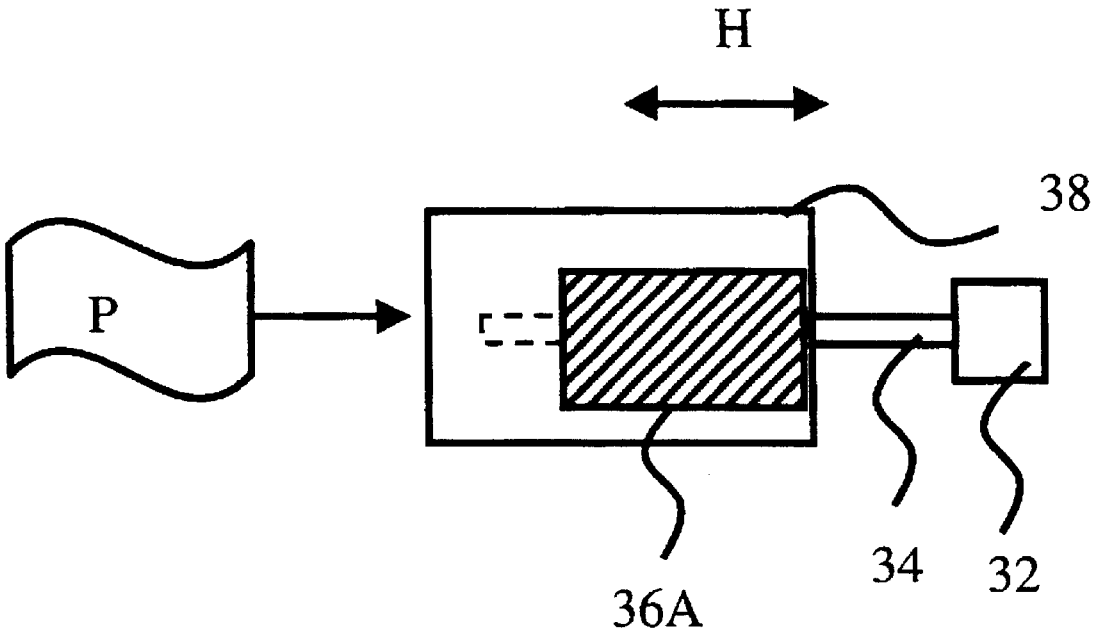
FIG. 3A shows a second embodiment of a collator of the present invention.
Figure 3B:
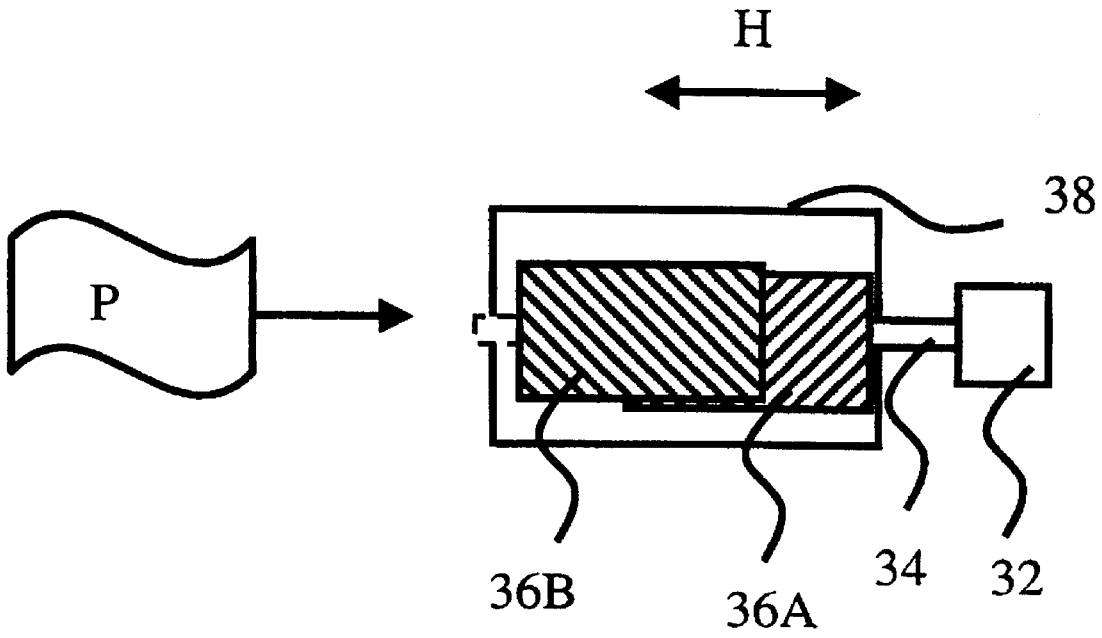
FIG. 3B shows the operation of the second embodiment.
Figure 3C:
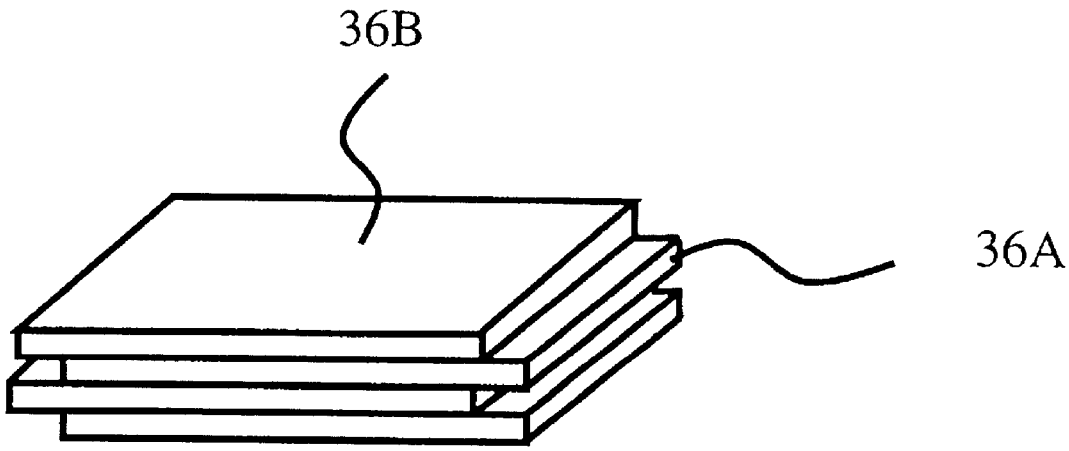
FIG. 3C shows the resulting stacking of the papers of the second embodiment.

FIG. 3A and FIG. 3B show a second embodiment of the present invention. Again, there is only one tray 38, which can be pushed to move back and forth in the H direction. The motor 32 drives the guiding rod 34 to effect the reciprocating motion, according to control signals received from a CPU. FIG. 3A shows the tray 38 in a first position to collect a first group of papers P to form a stack 36A. FIG. 3B shows the tray 38 in a second position to collect the second group of papers to form a stack 36B. The documents in stack 36A and stack 36B are staggered as shown in FIG. 3C. Thus the collating function is accomplished.

Figure 3D:
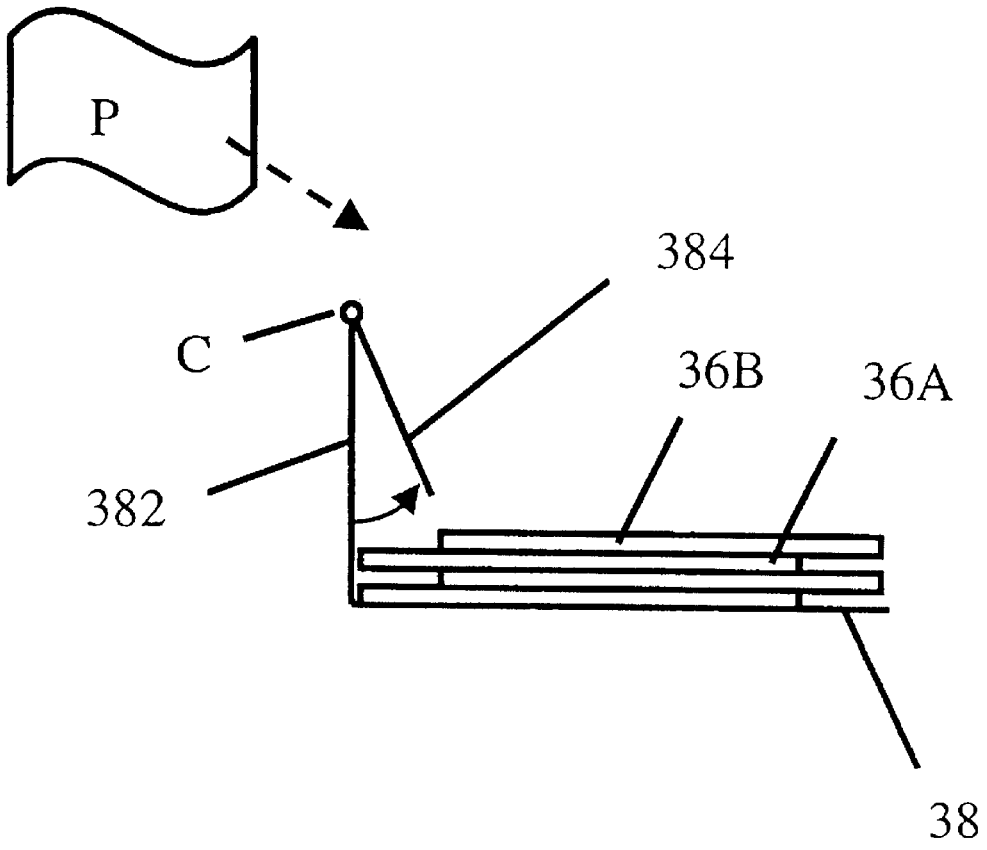
FIG. 3D shows a third embodiment of the present invention.

FIG. 3D shows a third embodiment of the present invention, which accomplishes the same result as that obtained in FIG. 3C. The collating tray 38 has a vertical wall 382. At the top of the side wall is an axle C, to which a guide plate 384 is attached. The guide plate 384 can swing back and forth according to the control signal from a CPU. When the guide plate 384 is at a first position and the angle between the guide plate 384 and the vertical wall 382 is zero, the papers dispatched from the source P are stacked up as a document 36A. When the guide plate 384 forms an angle, say 30 degrees, with the vertical wall 382, the papers dispatched from the source P are stacked up as a document 36B. The documents 36A and 36B are staggered as shown in FIG. 3C, which is the result of the separating operation shown in FIG. 3D.

Figure 3E:
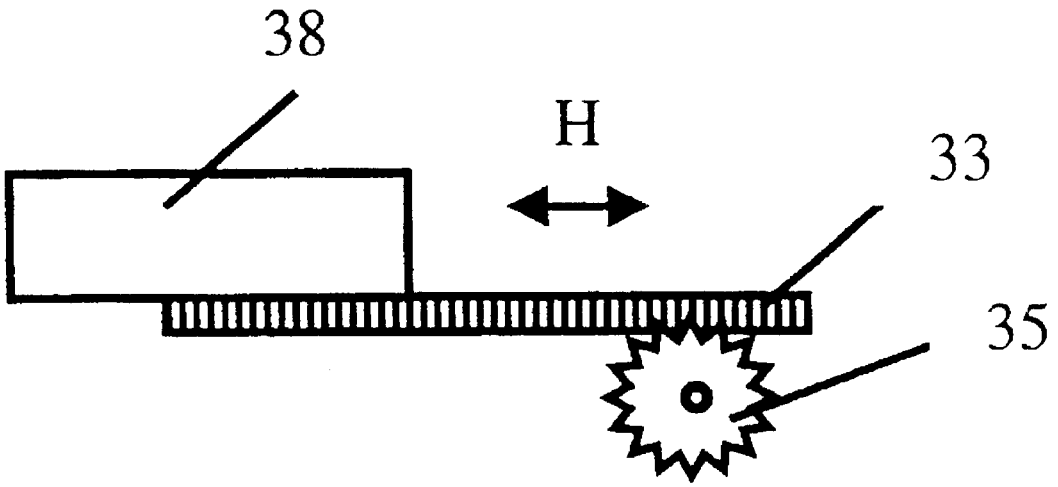
FIG. 3E shows a fourth embodiment of the collator of this invention.

FIG. 3E shows a fourth embodiment of the present invention which also can yields a result similar to that in FIG. 3C. The reciprocating motion is produced by a rack and pinion motion. A rack 33 is attached to the tray 38 and a pinion 35 driven by a motor engages the rack 33 to produce the reciprocating motion along the H direction. The papers collected by the tray are sorted into two stacks as shown in FIG. 3C.

Figure 4A:
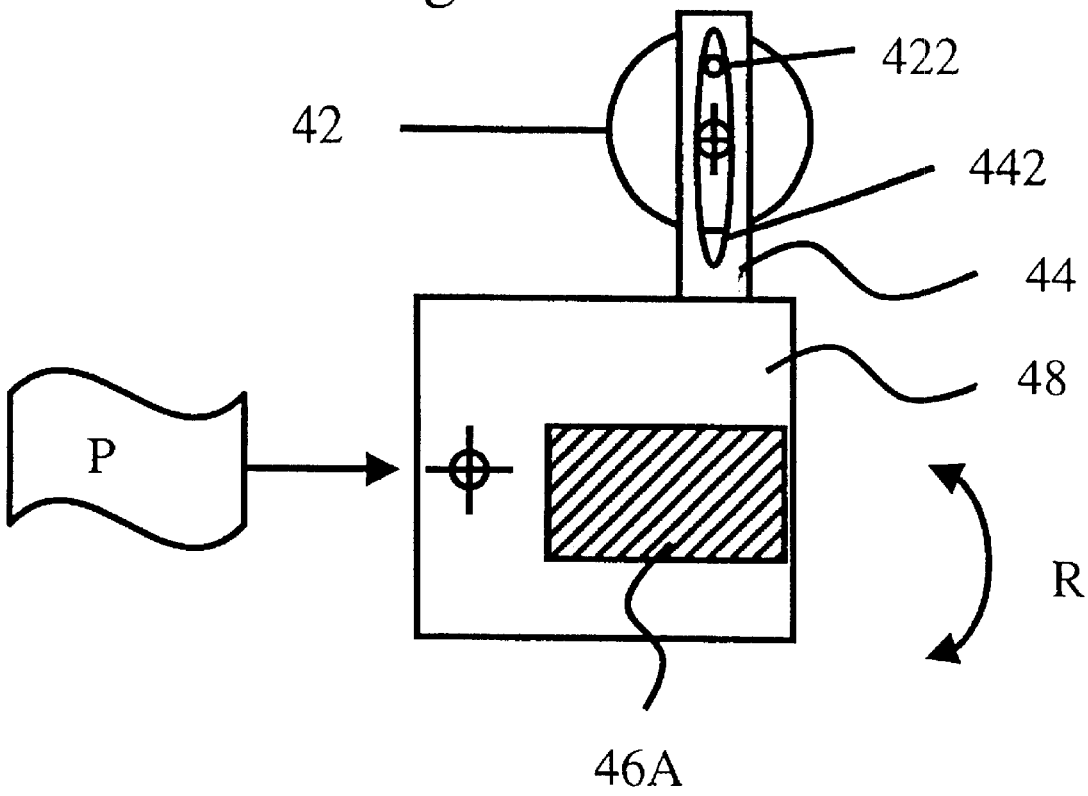
FIG. 4A shows a fifth embodiment of the collator of the present invention.
Figure 4B:
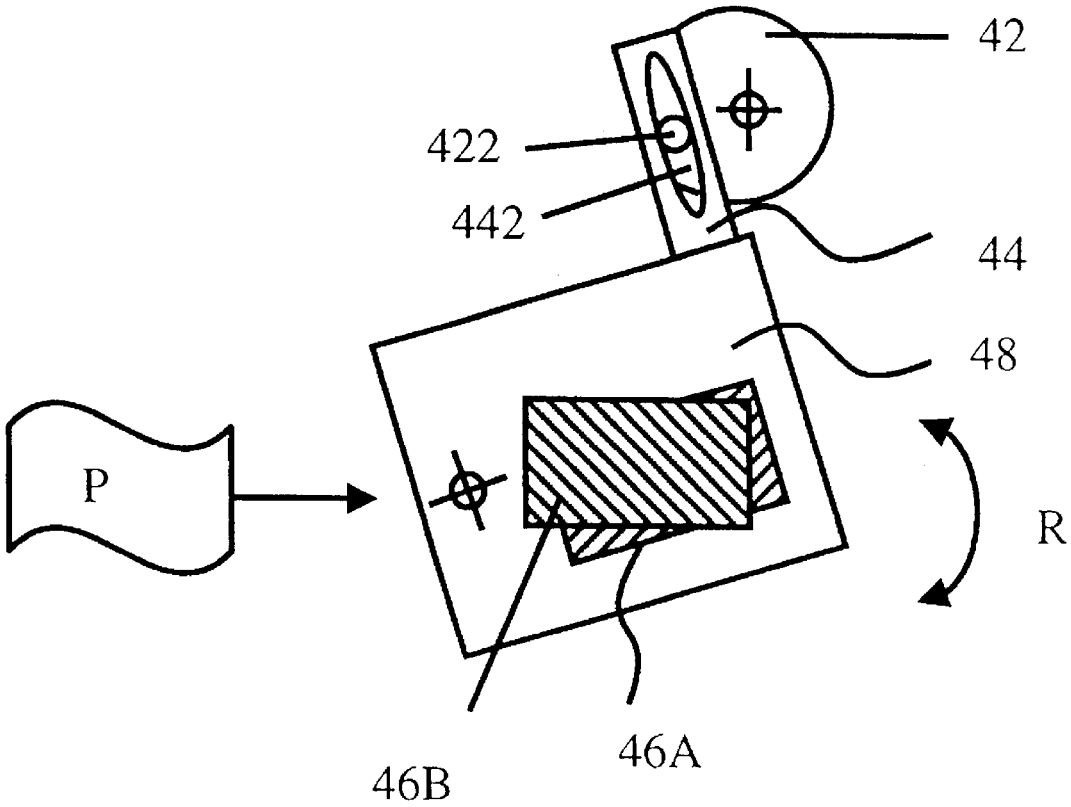
FIG. 4B shows the operation of the fifth embodiment.

FIG. 4A shows a fifth embodiment of the present invention. The tray 48 is pivoted at one end and is equipped with a slotted handle 44 with a slot 442. A driving wheel 42 has a pin 422 protruded from the edge of the wheel surface through the slot 442. When the wheel rotates, the pin 422 slides back and forth along the slot 442, causing the tray to rotate back and forth with respect to the axis the pivot. The motor driven wheel rotates according to the control signal from the CPU. FIG. 4A shows the tray 48 in a first position to collect the papers from source P as a stack 46A. FIG. 4B shows the tray 48 in a second position to collect papers from source P as a stack 46B. Thus the documents are separated and collated. The wheel 42 can also be replaced with an eccentric wheel or a cam.

Figure 4C:
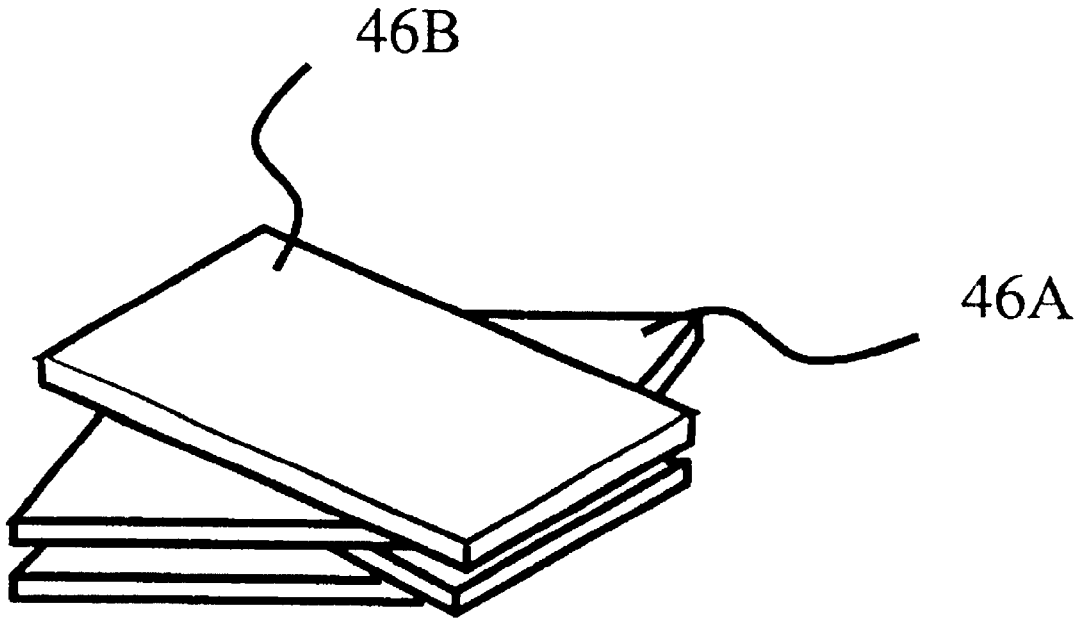
FIG. 4C shows the resulting stacking of the pages of the fifth embodiment.
Figure 4D:
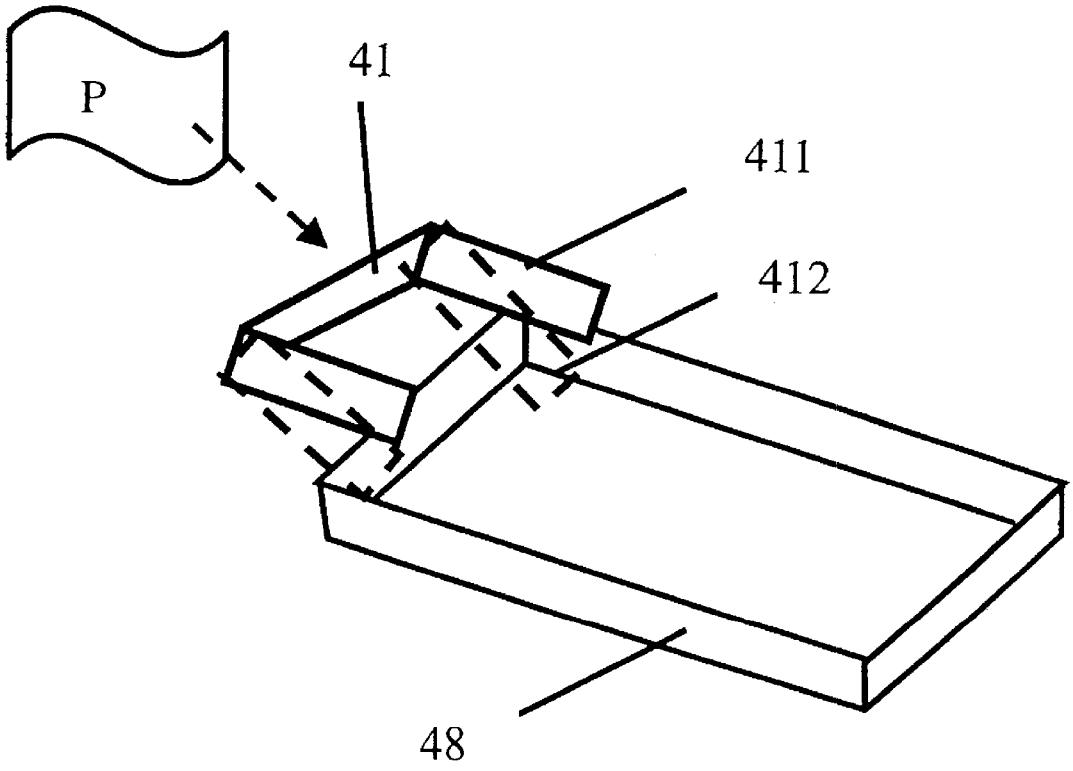
FIG. 4D shows a mechanism to effect the fifth embodiment.

FIG. 4D shows a sixth embodiment of the present invention. At the exit port of the paper source P is placed a guide 41, which has two side walls 411. The side walls 411 can be tilted at different angles. In one position of tilt, the side walls 411 are as shown in solid lines and guide the papers as stack 46A. In a second position of tilt, the side walls 412 are as shown in dotted lines and guide the papers as stack 46B. Thus the two stacks are sorted as shown in FIG. 4C.

Figure 4E:
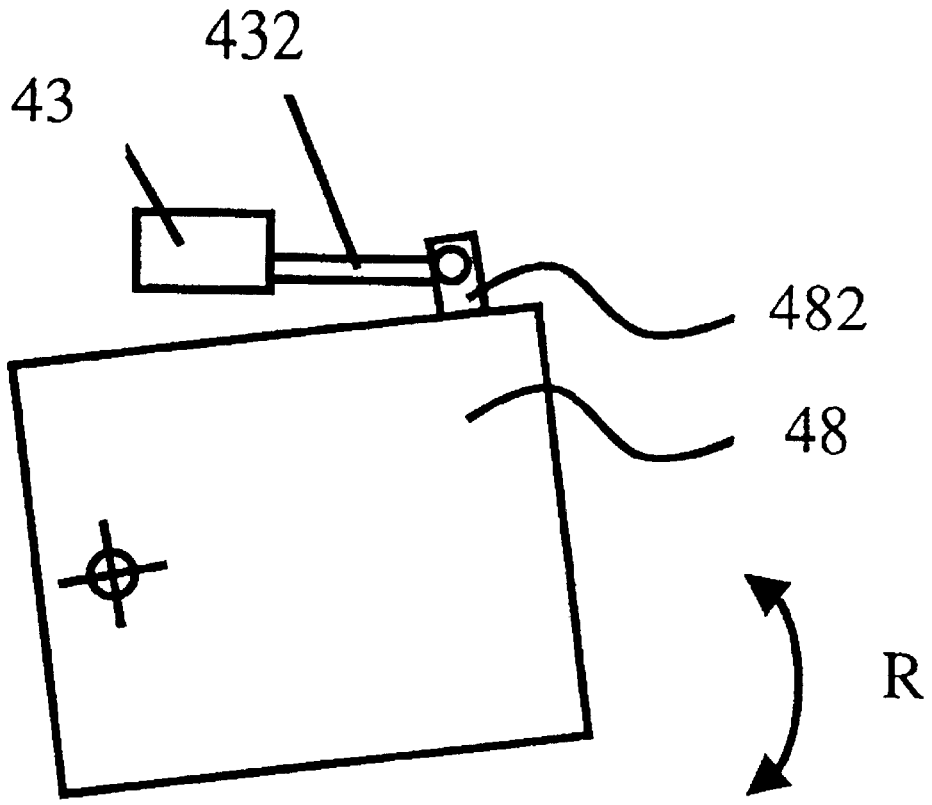
FIG. 4E shows another mechanism to effect the fifth embodiment.

FIG. 4E shows a seventh embodiment of the present invention. Here the tray 48 is pivoted at one end and attached to an arm 432 through a coupling 482. The arm 432 is actuated by turning on and off an electromagnet 43. The force on the electromagnet causes the tray to rotate back and forth along an arc R. The tray 48 collects the documents and separates them as shown in FIG. 4C.

Figure 4F:
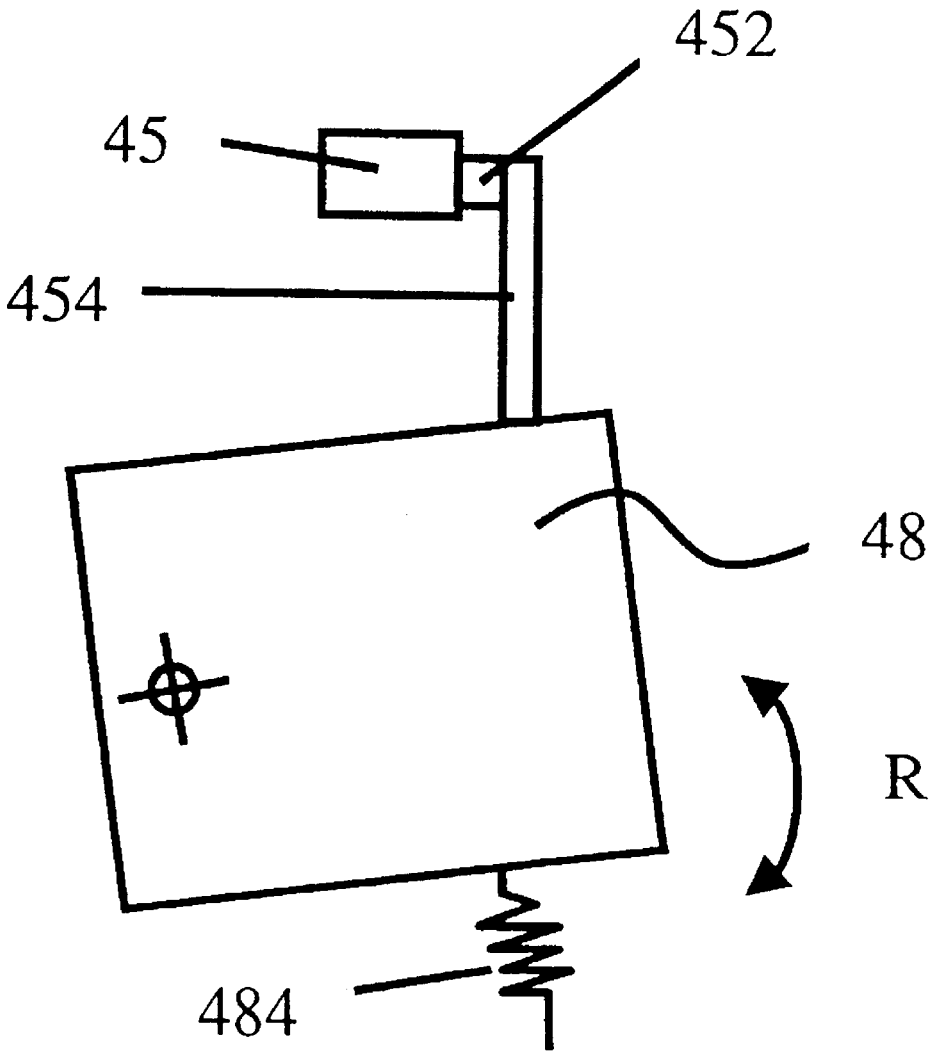
FIG. 4F shows still another mechanism to effect the fifth embodiment.

FIG. 4F shows an eighth embodiment of the present invention. A pivoted paper receiving tray 48 is attached to a belt 454, which is coupled to a driving motor 45 through an eccentric cam 452. The eccentricity of the cam 452 causes the tray 48 to move along the arc R. The other side of the tray opposite the belt 454 is pushed by a spring 484. With this arrangement, the tray 48 can move back and forth. Papers are received by the tray during stationary positions. In this manner, the papers are collated as shown in FIG. 4C.

Figure 5:
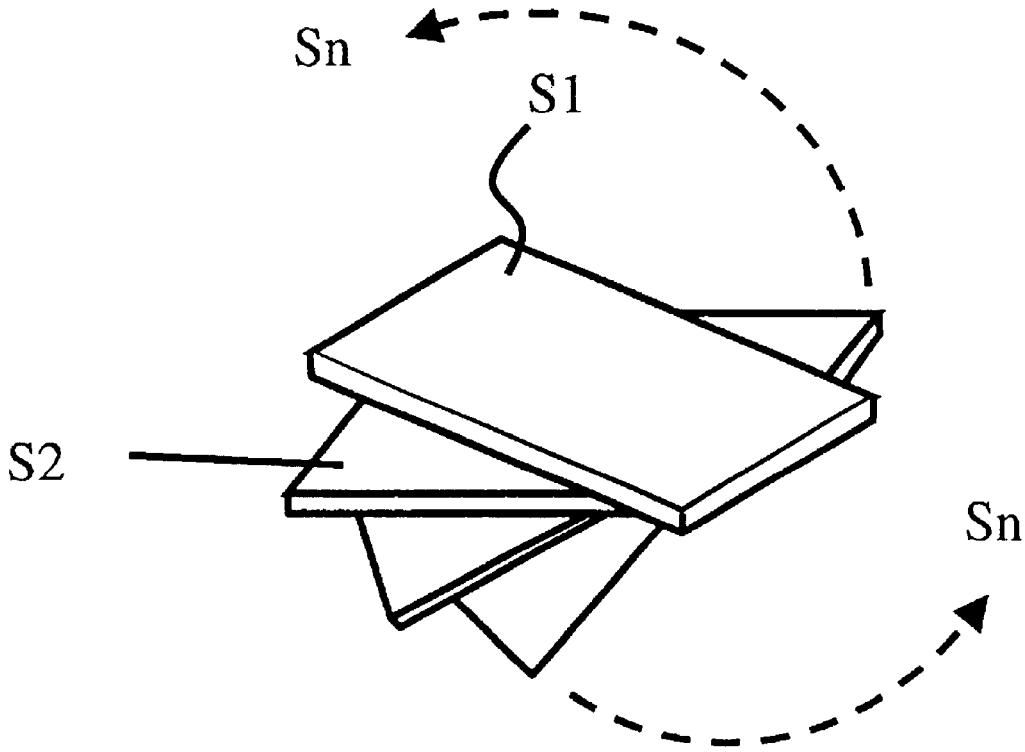
FIG. 5 shows N stacks after collation by means of the fifth embodiment.

FIG. 5 shows a ninth embodiment of the present invention to collate the papers into N number of stacks. In this scheme, the collecting tray is rotated N times in one cycle. For instance, if the tray is moved 30 degrees in every move, the collected papers are collated into 360/30=12 stacks. Any of the schemes shown in FIGS. 4A, 4B, 4D, 4E, and 4F with circular distribution can be used to effect this multiple stack collator.

While the preferred embodiments of this invention have been shown and described, it will be apparent to those skilled in this art that various modifications may be made in the embodiments without departing from the spirit of the present invention. Such modifications are all within the scope of this invention.

What is claimed is:

1. A collator for a printer, the collator comprising:

a tray for collecting papers exiting the printer, an end of the tray being pivotally installed in the printer; and an electromagnet attached to a first end of an arm, a second end of the arm being coupled to another end of the tray;

wherein when the electromagnet is turned on and off, the electromagnet causes the tray to pivotally rotate back and forth along a curvilinear direction so that the tray is capable of collecting and collating the papers.

2. A collator for a printer, the collator comprising:

a tray for collecting papers exiting the printer, an end of the tray being pivotally installed in the printer and collating the papers in at least two positions, the positions being separated from one another by an angular displacement;

a spring attached to a first side of the tray, the spring providing a biasing force to the tray in a first direction;

a motor attached to an eccentric cam; and a belt connecting the eccentric cam with a second side of the tray;

wherein when the motor causes the cam to rotate to a first angle, the eccentricity of the cam causes the belt to pivot the tray against the bias of the spring from a first position to a second position, when the motor causes the cam to rotate to a second angle, the eccentricity of the cam allows the bias of the spring to return the tray to the first position, so that the tray is capable of collecting and collating the papers.

* * * * *